US006354687B1

(12) United States Patent
Su et al.

(10) Patent No.: US 6,354,687 B1
(45) Date of Patent: Mar. 12, 2002

(54) INK-JET PRINTING AND SERVICING BY PREDICTING AND ADJUSTING INK-JET COMPONENT PERFORMANCE

(75) Inventors: Wen-Li Su; David Wetchler, both of Vancouver, WA (US)

(73) Assignee: Hewlett Packard Company, Palo Alto, CA (US)

( * ) Notice: Subject to any disclaimer, the term of this patent is extended or adjusted under 35 U.S.C. 154(b) by 0 days.

(21) Appl. No.: 09/449,239

(22) Filed: Nov. 24, 1999

(51) Int. Cl.[7] ..... B41J 29/38
(52) U.S. Cl. ..... 347/12; 347/19
(58) Field of Search ..... 347/12, 14, 19, 347/23, 29, 30, 33, 35

(56) References Cited

U.S. PATENT DOCUMENTS 5,473,351 A * 12/1995 Helterline et al. ..... 347/19
6,120,125 A * 9/2000 Kim ..... 347/19
6,161,913 A * 12/2000 Childers et al. ..... 347/19

FOREIGN PATENT DOCUMENTS

EP 0872345 10/1998

OTHER PUBLICATIONS

British Search Report dated Mar. 28, 2001. GB 0027776.4.

* cited by examiner

*Primary Examiner*—N. Le
*Assistant Examiner*—Shih-Wen Hsieh

(57) ABSTRACT

Ink-jet pen drop firing elements having extended use—namely, printheads used with a plurality of replaceable reservoirs—are provided with a more accurate life span and performance gauge by monitoring energy accumulations over time and using monitored data for certain printer activity or maintenance.

10 Claims, 3 Drawing Sheets

SINGLE DROP GENERATOR

FIRING SINGLE DROP GENERATOR

FIRING TWO DROP GENERATORS ($R_1 = R_2$)

FIRING "n" DROP GENERATORS ($R_1 = R_2 = R_n$)

INK-JET PRINTING AND SERVICING BY PREDICTING AND ADJUSTING INK-JET COMPONENT PERFORMANCE

BACKGROUND OF THE INVENTION

1. Field of the Invention

The present invention relates generally to ink-jet technology, more particularly to characterizing ink-jet performance and, even more specifically, to methods and apparatus for predicting and adjusting ink-jet component performance.

2. Description of the Related Art

The art of ink-jet technology is relatively well developed. Commercial products such as computer printers, graphics plotters, copiers, and facsimile machines employ ink-jet technology for producing hard copy. [For convenience, the term "printer" is used hereinafter as generic for all ink-jet hard copy apparatus; no limitation on the scope of the invention is intended by the inventors nor should any be implied.]The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988). As providing background information, the foregoing documents are incorporated herein by reference.

FIG. 1 (PRIOR ART) is a schematic depiction of an ink-jet hard copy apparatus 10. A writing instrument 12 has a printhead 14 having "drop generators" for ejecting ink droplets onto an adjacently positioned print medium, e.g., a sheet of paper 16, in the apparatus' printing zone 34. (The word "paper is used hereinafter for convenience as a generic term for all print media; the implementation shown is for convenience in explaining the present invention and no limitation on the scope of the invention is intended by the inventors nor should any be implied.) An endless-loop belt 32 is one type of known manner printing zone 34 input-output paper transport. A motor 33 having a drive shaft 30 is used to drive a gear train 35 coupled to a belt pulley 38 mounted on an fixed axle 39. A biased idler wheel 40 provides appropriate tensioning of the belt 32. The belt rides over a platen 36 in the printing zone 34. The paper sheet 16 is picked from an input supply (not shown) and its leading edge 54 is delivered to a guide 50, 52 where a pinch wheel 42 in contact with the belt 32 takes over and acts to transport the paper sheet 16 through the printing zone 34 (the paper path is represented by arrow 31). Downstream of the printing zone 34, an output roller 44 in contact with the belt 32 receives the leading edge 54 of the paper sheet 16 and continues the paper transport until the trailing edge 55 of the now printed page is released.

It is also known to have an on-board controller 62, electrically connected 60, 64 to the motor, to sensors 41 on the pulley, to the writing instrument 12, and to other electromechanical systems of the hard copy apparatus 10. Operation is administrated by the electronic controller 62 which is usually a microprocessor or application specific integrated circuit ("ASIC") controlled printed circuit board which, if necessary, for the particular hard copy apparatus connected by appropriate cabling to the computer (not shown). It is well known to program and execute imaging, printing, print media handling, control functions, and logic with firmware or software instructions for conventional or general purpose microprocessors or ASIC's. Within the printing zone 34, graphical images or alphanumeric text are created with the ink droplets deposited on the paper sheet 16 using state of the art color imaging and text rendering via dot matrix manipulation techniques.

A simplistic schematic of a swath-scanning ink-jet pen 12 is shown in FIG. 2 (PRIOR ART). The body of the pen 12 generally contains an ink accumulator and regulator mechanism 200. The internal accumulator and regulator are fluidically coupled 200' to an off-axis ink reservoir (not shown) in any known manner to the state of the art. The printhead 14 element includes an appropriate electrical connector 201 (such as a tape automated bonding flex tape) for transmitting signals to and from the printhead. Columns of nozzles 203 form an addressable firing array 205. The typical state of the art scanning pen printhead may have two or more columns with more than one-hundred nozzles per column. The nozzle array 205 is usually subdivided into discrete subsets, known as "primitives," which are dedicated to firing droplets of specific colorants. In a thermal ink-jet pen, the drop generator includes a heater resistor subjacent each nozzle which superheats ink to a cavitation point such that an ink bubble's expansion and collapse ejects a droplet from the associated nozzle 203. In commercially available products, piezoelectric and wave generating element techniques are also used to fire the ink drops. Other ink-jet writing instruments are known in the art; some, for example, are structured as page-wide arrays. Degradation or complete failure of the drop generator elements cause drop volume variation, trajectory error, or misprints, referred to generically as "artifacts," and thus affect print quality.

In some state of the art ink-jet printers, replacement ink reservoirs are available and thus use the same single writing instrument printhead 14 repeatedly, requiring a longer life than the intended one-time use disposable ink-jet cartridge that contains an on-board ink reservoir. Thus, one of the operational characteristics of concern to the designer is printhead 14 life. One gauge, or "ruler," that has been used in the prior art is drop counting. U.S. Pat. No. 5,583,547, DROP COUNT-BASED INK-JET PEN SERVICING METHOD, and U.S. Ser. No. 07/951,255, by Gast et al. describes exemplary methods and apparatus. In the main, drop counting and ink droplet flight-path monitoring provide information useful in controlling printer operations. There are certain advantages for the use of drop counting as a ruler to anticipate some characteristics of the printhead and to adjust future printer activity accordingly. While drop counting is a logical ruler, it has been found that it is not necessarily the best printhead life indicator. Printhead life based on a total drop count for the pen, or even per column count, assumes that the energy to firing nozzles in the array is always the same regardless of firing patterns. In fact, however, the total energy going into the printhead varies from print pattern to print pattern (low frequency text printing energy is substantially less than photo-quality color graphics printing) and from primitive to primitive (i.e., a particular firing sequence may fire from zero to all of the nozzles in a primitive and from one to all the primitives of the entire nozzle array). Thus, drop counting with respect to determining printhead performance and life-expectancy characteristics is effectively only a type of averaging technique.

There is a need for a more accurate predictor of printhead firing element life and performance. The tool should be easily implemented and provide real-time data useful on-the-fly to adjust printer activity or to provide information useful to the end-user.

SUMMARY OF THE INVENTION

In a basic aspect, the present invention provides an ink-jet printhead printing method for a printhead having a predetermined matrix of drop generators. The method includes the of: setting a predetermined accumulated energy budget value for each addressable subset of drop generators; determining a next drop generator firing sequence; setting firing energy for addressed subsets of drop generators based on a function of current accumulated energy budget; printing with the next drop generator firing sequence; resetting said predetermined accumulated energy budget value for addressed subsets of drop generators as a function of number of nozzles fired in the step of printing as reset accumulated energy budget values; repeating steps b) through f) for each firing sequence of a current print job; and retaining said reset accumulated energy budget values as said predetermined accumulated energy budget values for a next print job.

In another basic aspect, the present invention provides a method of dynamically adjusting thermal ink-jet printhead drop generator firing energy including the steps of: monitoring energy accumulation values for each separately addressable set of drop generators; and adjusting firing energy to addressed drop generators for a next firing sequence based on the energy accumulation values.

In another basic aspect, the present invention provides a method for scheduling thermal ink-jet printhead servicing, including the steps of: monitoring energy accumulation values for each separately addressable set of drop generators; and performing predetermined printhead service routines based on the energy accumulation values.

In another basic aspect, the present invention provides a computer memory having a tool for measuring thermal ink-jet performance, including: computerized routines for monitoring energy accumulation values for each separately addressable set of drop generators; and computerized routines for indicating printhead performance characteristics based on the energy accumulation values.

In another basic aspect, the present invention provides a method for determining printhead life, including the steps of: monitoring energy accumulation data for a first printhead; comparing data derived from said step of monitoring with predetermined energy accumulation data empirically derived for at least one printhead of a substantially comparable printhead type to said first printhead; and predicting remaining printhead life from data derived from said step of comparing.

In another basic aspect the present invention provides a computer memory for ink-jet printing and servicing including:computer readable routines for setting a predetermined accumulated energy budget value for each addressable subset of drop generators; computer readable routines for determining a next drop generator firing sequence; computer readable routines for setting firing energy for addressed subsets of drop generators based on a function of current accumulated energy budget; computer readable routines for printing with the next drop generator firing sequence; computer readable routines for resetting said predetermined accumulated energy budget value for addressed subsets of drop generators as a function of number of nozzles fired in the step of printing as reset accumulated energy budget values; computer readable routines for repeating the process for each firing sequence of a current print job; and computer readable routines for retaining said reset accumulated energy budget values as said predetermined accumulated energy budget values for a next print job.

Some advantages of the present invention are:

- it provides a measurement tool that is based on actual effects incurred by an ink-jet drop generator;
- it provides a measurement tool that can be used to alter ink-jet printhead activity and accurately extend printhead life;
- it provides a means for lowering ink-jet writing instrument design margins and associated manufacturing costs;
- it provides a measurement gauge that takes into account individual nozzle energy use and can adjust firing energy real-time based on prior use;
- it provides a method more accurate than state of the art measurement tools in which error factors tend to be cumulative, leading to premature printer activities such as printhead replacement;
- it provides a method for predicting and extending printhead life by optimizing drop generator firing element performance and life;
- it provides a method for optimizing ink bubble cavitation with minimum wasted energy;
- optimized ink bubble cavitation results in lower printhead operation temperatures; and
- it provides for better ink drop volume control.

The foregoing summary and list of advantages is not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(*d*) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following detailed description and the accompanying drawings, in which like reference designations represent like features throughout the FIGURES.

Figure 1:
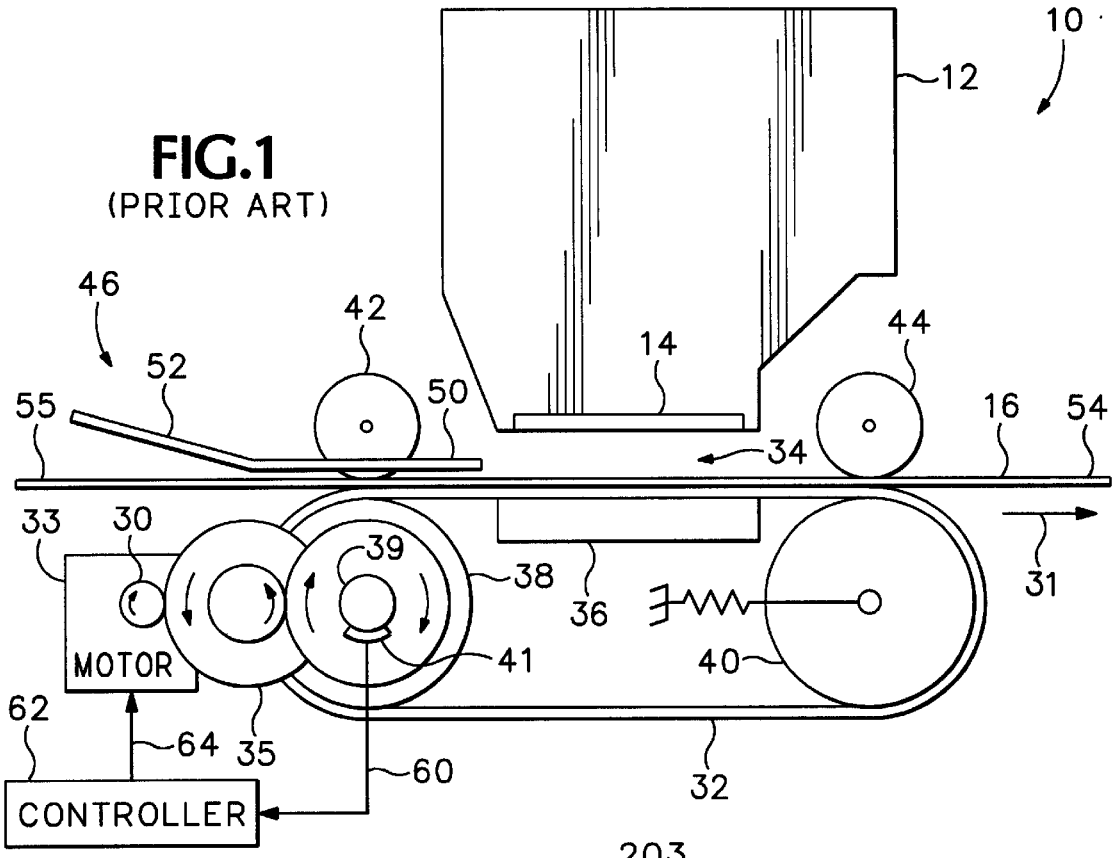
FIG.1 (PRIOR ART)
FIG. 1 (PRIOR ART) is a schematic, in elevation view, of an ink-jet hard copy apparatus.
Figure 2:
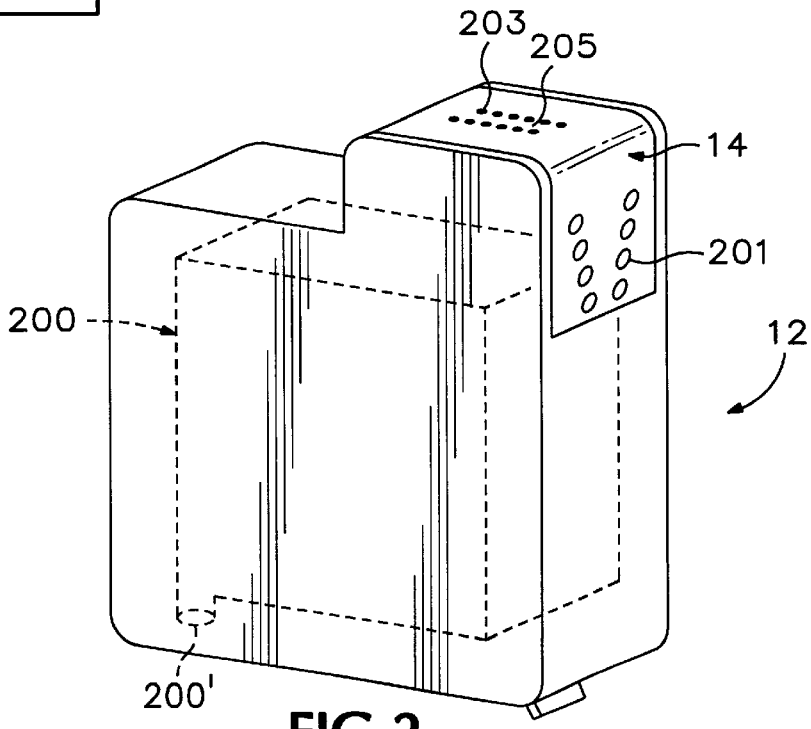
FIG.2 (PRIOR ART)
FIG. 2 (PRIOR ART) is a schematic, in perspective view, of an ink-jet pen and printhead typical of the apparatus as shown in FIG. 1.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventors for practicing the invention. Alternative embodiments are also briefly described as applicable. The present invention will be explained in an exemplary embodiment for a thermal ink-jet printhead, i.e., a printhead which uses an array of heater resistors for generating the droplets of ink fired from the associated nozzles. It will be recognized by those skilled in the art that the methodology described can be extended to other known manner forms of ink drop generators such as piezoelectric elements and the like commonly used in the state of the art ink-jet hard copy apparatus.

For describing the present invention, the inventors define the printhead characterizing tool, or "ruler," as "Accumulated Energy." The energy (in Joules) put through each individual resistor of a thermal ink-jet drop generator for each ink droplet firing is:

$$E_{dg}=(\text{pulse width "PW"})*(\text{voltage}^2/\text{resistance})$$

or, $$E_{dg}=[(PW)(V^2+R)] \qquad \text{Equation 1.}$$

Thus, it can be recognized that an individual drop generator can have a characteristic energy budget defined as a function of what pulse width and voltage is cycled through its resistor during each firing cycle. Generally, drop generator life and performance are not necessarily dependent on just the number of cycles of firing pulses, as either pulse width or voltage or both can vary. That is to say that in reality, depending on what PW and V are during an immediate nozzle firing, printhead life is either reduced or extended relative to the overall energy budget and it is not just dependent on cycles of firing pulses put through the printhead, i.e., drop counting. In fact, pulse width and voltage can be controlled; that is, during every firing cycle when less than all drop generators are strobed, some value of $E_{dg}=(PW)*(V^2/R)$ can be "added back" into the total Accumulated Energy budget predefined during manufacture of the printhead. [Known manner digital data storage techniques can be employed; further detailed discussion of such is not necessary to an understanding of the present invention.] Moreover, based on a current value of Accumulated Energy for a specific drop generator or set of drop generators, the controller program can be used to adjust PW or V, or both, to extend the life of a resistor. In other words, using Accumulated Energy as a ruler, some characteristics of the printhead performance can be anticipated and printer activity adjusted accordingly.

In a state-of-the-art thermal ink-jet printer 10, the printhead 10 can have a drop generator matrix of several hundred nozzles 203, multiplexed into subset primitives to fire droplets of ink (such as the cyan, magenta, yellow subtractive primary colorants, black ink, fixer fluids, and the like as would be known in the art). Digital addressing techniques are used, for example, such as those described in U.S. Pat. No. 5,134,425 by Yeung for an OHMIC HEATING MATRIX (assigned to the common assignee of the present invention and incorporated herein by reference). Yeung discloses a specific implementation where each heating element in a thermal ink-jet printhead has an interconnect and drive circuitry dedicated exclusively to it or the elements are configured into a matrix in which the heating elements share the interconnect and drive circuitry. The heater resistors in each matrix row share drive circuitry and the resistors in each matrix column share electrical ground. If an individual resistor is "addressed"—i.e., is selected for firing—the drive voltage is applied to its row connector and since its column connector is grounded, a voltage drop across it is generated, dissipating electrical power as heat into the surrounding ink and firing a droplet from the associated printhead nozzle.

One key to the present invention is the recognition that Accumulated Energy is not equal to the total number of drops fired by the printhead at a given time. Based on the state of the art addressing of a printhead array 205 and the art of dot matrix printing, there are going to be drop generators that we are used more often than others and nozzles that are fired more often as groups of nozzles rather than individual nozzles. At any one instance in time, different sets of nozzles are fired when an address is strobed. In the present preferred embodiment, firing data tracking is based on address monitoring, so the number in the set ranges from zero to the number of primitives on the printhead. [It will be recognized by those skilled in the art that rather than primitive monitoring, nozzle-by-nozzle monitoring is also possible in the state of the art, but may not be commercially practical in view of cost exigencies of the marketplace.]

The energy variables, PW and V, are not adjusted based on how many nozzles are being fired in a primitive at any instance, but the total resistance which includes parasitic resistance, "Rt"—such as trace resistance, interconnect resistance, flex circuit connector resistance, resistance from heaters of the primitive not fired in a particular firing cycle, and the like as would be known in the art—and the actual drop generator resistance of fired nozzles, "Rpp," which changes based on how many drop generators are being fired at that instant in time.

For example, the energy passed through printhead drop generator number ten of thirty in the primitive of the array will be lower if five other nozzles within that primitive are being fired at the same time versus if no other nozzles are being fired at the same time.

By analogy, the primitive set can be thought of as a current divider as illustrated in FIGS. 3A–3D and Ohm's law determines the current, $i_{(1\ through\ n)}$, through each addressed drop generator heater, $R_{(1\ through\ n)}$. In a drop counting scheme, a count of one would be added in any firing sequence case of FIGS. 3B through 3D. Yet, in fact, Accumulated Energy is different in each of the cases as the electrical current seen by each resistor heater in each case is different.

Figure 3A:
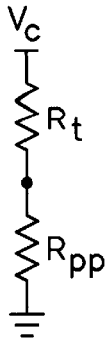
FIGS. 3A through 3D are electrical equivalent diagrams for ink-jet drop generator firing patterns with a pen as shown in FIGS. 1 and 2.
Figure 3B:
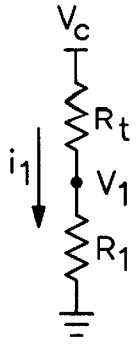
Figure 3C:
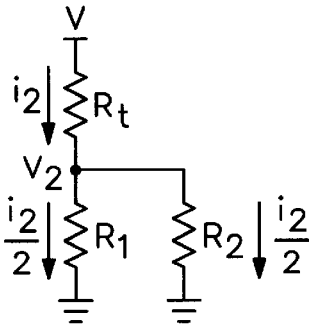
Figure 3D:
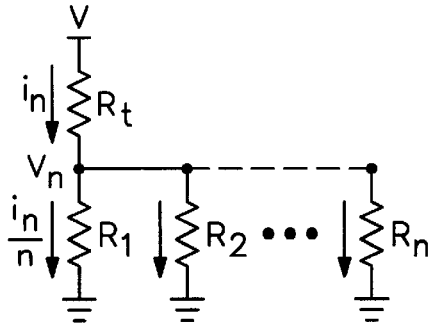

If E is the energy for one nozzle firing as seen by that drop generator firing resistor R1 in FIG. 3B, and E*is the energy for each of the two drop generator firing of resistors R1 and R2 in FIG. 3C (where R1=R2):

$$E=(PW)(V_1^2/R)=(PW)(i_1^2)(R1) \qquad \text{Equation 2,}$$

and $$E^*=(PW)(i_2/2)^2(R1) \qquad \text{Equation 3.}$$

Looking at the ratio:

$$E^*/E=\frac{\frac{(PW)(i_2^2)(R1)}{4}}{(PW)(i_1^2)(R1)}=\frac{i_2^2}{4i_1^2} \text{ or,} \qquad \text{Equation 4}$$

$$=\frac{\frac{Vc^2}{\left(Rt+\frac{1}{2}R1\right)^2}}{\frac{4Vc^2}{(Rt+R1)^2}}.$$

Therefore, $$E^{\star}/E = \frac{(Rt+R1)^2}{4(Rt+R1/2)^2}. \quad \text{Equation 5}$$

$$\sqrt{E^{\star}}/\sqrt{E} = \frac{Rt+R1}{2(Rt+R1/2)} = \frac{Rt+R1}{2Rt+R1} < 1. \quad \text{Equation 6}$$

In other words, comparison of the denominator versus the numerator in this measurement technique proves that $$E^*/E<1 \quad \text{Equation 8,}$$

or that E for one nozzle firing is greater than E*for multiple nozzle firings. Therefore, with Accumulated Energy as the ruler, the two cases are incremented by two different values, developing a much more accurate measurement of true printhead life.

With E*now representing n-drop generator firing, the ratio can be generically expressed as:

$$E^{\star}/E = \frac{(Rt+R1)^2}{n^2(Rt+1/n\,R1)^2}, \quad \text{Equation 9}$$

where Rt is printhead parasitic resistance, R1 is firing resistor resistance, and n is the number of drop firing resistors in the primitive set. Thus, in other words, in an actual design implementation, the difference between E*and E is dependent on "n" and the relative difference between R1 and Rt.

Thus it can be recognized that 1000 drops fired from two different nozzles can leave those drop generators having two different Accumulated Energy values. Therefore, whereas the life expectancy of the drop generator resistors by drop counting would be given an identical value in any of the cases shown in FIGS. 3B–3D, based on the real-time "Accumulated Energy" measurement present a more accurate picture of printhead life characteristics. Thus, the driver software controls can then make dynamic adjustments to promote improved future printhead activity.

In accordance with the present invention, the most common reaction to Accumulated Energy data is for the adjustment of PW and V. There is a characterization on what the limits of the variables are:

PWmin<PW<PWmax, and

Vmin<V<Vmax, so as to achieve the desired optimal firing energy, the device driver software selecting the desired variable and how much to adjust it. Depending on what and how much change to PW, V or both is made, the Accumulated Energy for the adjusted drop generators then grows at different rates to balance the discrepancy. Generally, therefore, using Accumulated Energy for a measurement tool, adjustments to pen firing parameters are based on the real-time Accumulated Energy in the predetermined budget and printhead printing and servicing activities can be improved.

Figure 4:
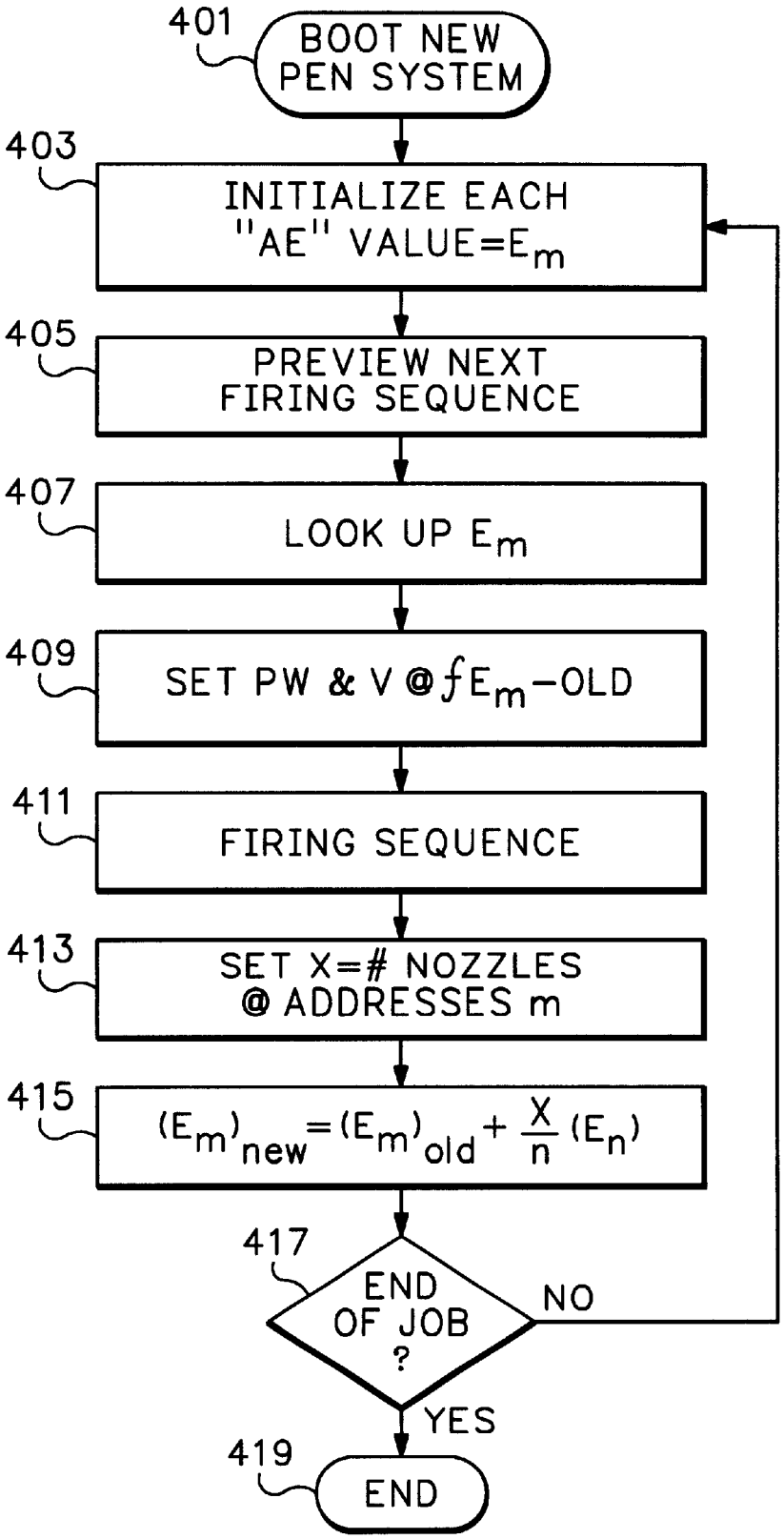
FIG. 4 is a flow chart demonstrating the methodology in accordance with the present invention as may be employed in an ink-jet hard copy apparatus as shown in FIG. 1.

Operation of a method for basing current firing conditions based to Accumulated Energy is illustrated by the flow chart of FIG. 4. For purpose of explanation, assume a new pen 12 system is booted for the first time, step 401. The Accumulated Energy for each monitored element—drop generator, primitive, or the like for the specific implementation—is initialized, "Em," where "m" is a specifically printhead array primitive address 1 through m having nozzles 1 through n. A full Accumulated Energy budget, unit-less integer—or other initial predetermined designator related to design parameters for a specific printhead construct—Em value is set, step 403.

Printhead firing is controlled by the firing algorithm. In this example, Accumulated Energy is monitored via firing addresses. The next firing sequence is previewed to determine which addresses are being strobed, step 405. Using the addressing scheme, the controller looks up the current value for each Em, step 407, redesignating those values as "$Em_{old}$." For the next firing at addresses m, the appropriate pulse width and voltage are set by applying a predetermined function on the current Em, f($Em_{old}$), step 409.

Figure 5:
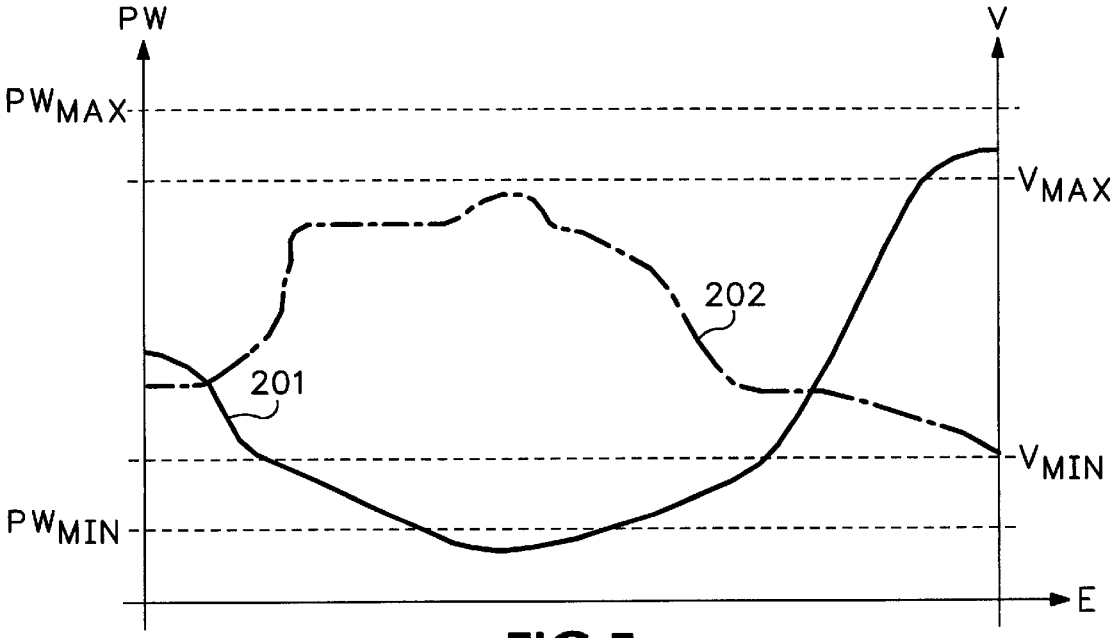
FIG. 5 is a graphical depiction of ink-jet printhead firing energy parameter variables.

FIG. 5 is a graphical depiction of the relationships involved in one such predetermined function, f(E) for reacting to current Accumulated Energy values. Given initial, designed determined, firing element capacity—e.g., empirical resistor degradation data—operating voltage—curve 202—in a new printhead might be raised, to burn in the optimal performance; simultaneously, pulse width—curve 201 can be reduced to meet drop generator turn-on energy requirements for the specific design. These curves can be implemented as a mathematical function. Toward end-of-life, less voltage input may prevent premature burn out, but a greater pulse width is required to ensure turn-on and firing.

As will be recognized by a person skilled in the art, a variety of characterizations can be employed. In another simple example, a look-up table can provide the firing levels; e.g.:

if 0<Em<E1, set PW=a, V=b;

if E1≦Em<E2, set PW=c, V=e;

et seq.

In other words, the function can be tailored to a specific printhead design. Moreover, the empirically derived factory characterizations of a specific printhead design can be altered real-time by monitoring product performance during its life and adjusting the firing output parameters to fit actual performance data. For example, if over a period of real-time use temperature excursions are far less than experienced in manufacture, current Accumulated Energy values may be boosted back up and life expectancy extended for that printhead. Moreover, real time comparison of such empirical data stored on-board a hard copy apparatus can be used in conjunction with current data from monitoring Accumulated Energy to predict the remaining printhead life expectancy.

Returning to FIG. 4, given the characterizing function derived pulse width, PW, and voltage, V, the strobed addresses are fired, step 411, in the selected sequence. From the firing algorithm, it is known how many of the In" nozzles at addresses "m" were fired and that number is registered as "x" for each address, step 413.

Next, step 415, Em is reset to reflect the energy experienced during the firing sequence, where:

$$(Em)_{new}=(Em)_{old}+(x/n)(En), \quad \text{Equation 10,}$$

where En is the energy seen by each nozzle if all "n" nozzles were fired in the address.

If the print job is finished, step 417, YES-path, the operation waits for the next print job, step 419. If the print job is continuing, step 417, NO-path, the next firing sequence is previewed, step 405, and the routine continues accordingly.

Thus, each address Accumulated Energy value is incremented at a rate which is based upon a ratio of the number of nozzle(s) fired in the address to the maximum number of nozzles (n) fired. Tracking real time Accumulated Energy for each primitive address (or as mentioned, each drop generator in a more sophisticated, expensive implementation) provides a factor for comparison to a predetermined Energy Accumulation Budget ("EAB"), empirically developed in design and manufacture. By knowing the real-time depletion of the Energy Accumulation Budget that has been used for a set of nozzles, certain printer activity or maintenance can be appropriately performed.

As one example, step 419, can also be a starting point when Em indicates certain maintenance should be performed or trigger indicators to the end-user.

For example, one use of the Accumulated Energy data would be in providing accurate starting points for printhead controls such as pulse width adjustments, where temperature of the printhead is monitored and pulse width is adjusted based upon current printhead operating temperature. In the main, as temperature rises, viscosity of ink falls. A pulse width algorithm changes the total energy delivered to the pen to compensate for the thermal variations.

As another use, certain Accumulated Energy levels detection can be set as status of nozzle health; e.g., EA=full EAB=new; EA=50% EAB=½ life, et seq.

Certain Accumulated Energy levels detection can be set as triggers for automating different printhead service station routines; e.g., EA=90%=perform 1st standard maintenance routine, EA=80%=perform 2nd standard maintenance routine, EA=75%=perform 1st extended maintenance routine, et seq.

Certain Accumulated Energy levels detection can be used in comparison with other measurements to predict printhead life and inform the end-user. For example, a known characteristic of printhead performance that is regularly checked is the "turn-on energy" ("TOE"), the pulse required to actually fire a drop (versus e.g., a warming pulse). [TOE is described in more detail in, for example, U.S. Pat. No. 5,418,558, Hock et al. for DETERMINING THE OPERATING ENERGY OF A THERMAL INK JET PRINTHEAD USING AN ONBOARD THERMAL SENSE RESISTOR, assigned to the common assignee herein and incorporated herein by reference in its entirety. However, further description herein is not essential to an understanding of the present invention.]Comparison of changes to TOE and Accumulated Energy change can provide a picture of the average use by the particular hard copy apparatus, thus a prediction of remaining printhead life and the need and amount of dynamic adjustments needed to insure appropriate print quality.

As a corollary, knowing Accumulated Energy for each nozzle, resistor life can be extended by changing the input power or the pulse width with the driver software where an indication is determined that extensive use of that drop generator over others would lead to a premature printhead failure.

Also, based on Accumulated Energy knowledge, the driver can perform better printhead temperature management (e.g., re-modulating warming pulse distribution), make more accurate ink level prediction, provide better printing mode controls, and the like as would be known in the art.

Another reactive print activity based on Accumulated Energy data, is to switch to a swath multi-pass print mode to cover expected print defects.

Another reactive print activity based on Accumulated Energy data, is to substitute alternative nozzle or activate redundant nozzles to cover expected defects, extending pen life.

In other words, using Accumulated Energy knowledge, real-time printer activities can be implemented more accurately than with other measurement tools. In accordance with the present invention, a more accurate measurement tool, Accumulated Energy, is available because its determination encompasses temperature, actual resistance and parasitic resistance relationships, energy differences between simultaneous firing of different numbers of nozzles, allowing the driver software to react to the actual printhead condition more accurately. The Accumulated Energy data at any point in time of the life of the printhead is in this sense the integral energy experience of the printhead and a gauge of how to structure future printhead activity.

While in the foregoing description, the described measurement tool operation as shown in FIG. 4 used an firing address scheme for tracking Accumulated Energy—that is each address maintains its own Accumulated Energy gauge—it will be recognized by those skilled in the art that given commercial affordability limits, any monitoring construct, even a nozzle-by-nozzle energy data tracking and nozzle-by-nozzle power modulation on a full page array writing instrument can be implemented in accordance with the present invention.

The present invention may be implemented as a computer readable program code in any conventional software or firmware manner as would be known in the art. It can be implemented on-board or downloadable into a controller memory of a standalone device, such as a Hewlett-Packard™ facsimile machine, or for a computer peripheral hard copy apparatus such as the HP™ DeskJet™ printer series in a software or memory device combinational format as may be suited to any particular implementation.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best-mode practical application to thereby enable others skilled in the art to understand the invention for various embodiments and with various modifications as are suited to the particular use contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase:
"means for . . . "

What is claimed is:

1. An ink-jet printhead printing method for a printhead having a predetermined matrix of drop generators, comprising the steps of:

a) setting a predetermined accumulated energy budget value for each addressable subset of drop generators;

b) determining a next drop generator firing sequence;

c) setting firing energy for addressed subsets of drop generators based on a function of current accumulated energy budget;

d) printing with the next drop generator firing sequence;

e) resetting said predetermined accumulated energy budget value for addressed subsets of drop generators as a function of number of nozzles fired in the step of printing as reset accumulated energy budget values;

f) repeating steps b) through f) for each firing sequence of a current print job; and g) retaining said reset accumulated energy budget values as said predetermined accumulated energy budget values for a next print job.

2. The method as set forth in claim 1, said step of resetting comprising the step of:

said firing energy for an addressed subset is determined by the equation:

$$E^{*}=(PW)(i_n/n)^2(R)$$

where PW=pulse width, i=electrical current=V/R, where V=firing voltage source, R=resistance of each drop generator in the subset, n=number of resistors used in next firing sequence.

3. The method as set forth in claim 2, where setting firing energy for addressed subsets of drop generators based on a function of current accumulated energy budget further comprises:

determining when E1<Em<E2, and setting PW=a and V=b, where E1 and E2 are variables associated with predetermined values of Em, and a and b are predetermined pulse width and supply voltage values, respectively, associated with each of said predetermined values of Em within each range of E1 to E2.

4. The method as set forth in claim 3, comprising the step of:

determining when $Em>E_{eol}$, where $E_{eol}$ is a predetermined value indicating an end of printhead life.

5. The method as set forth in claim 4, comprising the further step of:

providing a signal indicative of end of life of a current printhead.

6. The method as set forth in claim 2, the step of resetting said predetermined accumulated energy budget value for addressed subsets of drop generators as a function of number of nozzles fired in the step of printing as reset accumulated energy budget values further comprising:

Em is reset to reflect the energy experienced during the firing sequence, where:

$$(Em)_{new}=(Em)_{old}+(x/n)(En),$$

where En is the energy seen by each nozzle if all "n" nozzles were fired in the address, and x=actual number of nozzles fired.

7. The method as set forth in claim 1, comprising the steps of:

monitoring each said addressable subset reset accumulated energy budget value;

automatically servicing said printhead at predetermined accumulated energy budget values.

8. The method as set forth in claim 1, comprising the steps of:

monitoring each said addressable subset reset accumulated energy budget value;

detecting at least one predetermined accumulated energy budget value, $E_{check}$, indicative of a predetermined printhead condition; and sending a signal indicative of a condition of current accumulated energy budget value Em exceeding the predetermined accumulated energy budget value, $Em>E_{check}$.

9. A method for scheduling thermal ink-jet printhead servicing, comprising the steps of:

monitoring energy accumulation values for each separately addressable set of drop generators; and performing predetermined printhead service routines based on the energy accumulation values.

10. A computer memory for ink-jet printing and servicing comprising:

means for setting a predetermined accumulated energy budget value for each addressable subset of drop generators;

means for determining a next drop generator firing sequence in a current print job;

means for setting firing energy for addressed subsets of drop generators based on a function of current accumulated energy budget;

means for printing with the next drop generator firing sequence;

means for resetting said predetermined accumulated energy budget value for addressed subsets of drop generators as a function of number of nozzles fired in the step of printing as reset accumulated energy budget values; and means for retaining said reset accumulated energy budget values as said predetermined accumulated energy budget values for a next print job.

* * * * *